US007040612B2

(12) United States Patent
Garner et al.

(10) Patent No.: US 7,040,612 B2
(45) Date of Patent: May 9, 2006

(54) FOLDING APPARATUS AND METHOD

(75) Inventors: Wilfred Macleod Garner, Leighton Buzzard (GB); Paul Stuart Garratt, Milton Keynes (GB)

(73) Assignee: Morgana Systems Limited, (GB)

( * ) Notice: Subject to any disclaimer, the term of this patent is extended or adjusted under 35 U.S.C. 154(b) by 0 days.

(21) Appl. No.: 10/473,486

(22) PCT Filed: Mar. 28, 2002

(86) PCT No.: PCT/GB02/01232

§ 371 (c)(1),
(2), (4) Date: Mar. 12, 2004

(87) PCT Pub. No.: WO02/079066

PCT Pub. Date: Oct. 10, 2002

(65) Prior Publication Data

US 2004/0155394 A1 Aug. 12, 2004

(30) Foreign Application Priority Data

Mar. 29, 2001 (GB) ..... 0107883

(51) Int. Cl.
*B41F 13/58* (2006.01)
*B41L 1/32* (2006.01)

(52) U.S. Cl. ..... 270/8; 270/39.08; 493/444

(58) Field of Classification Search ..... 270/8, 270/9, 20.1, 32, 39.08; 493/8, 10, 444; 101/226
See application file for complete search history.

(56) References Cited

U.S. PATENT DOCUMENTS

| | | | | |
|---|---|---|---|---|
| 4,643,705 | A * | 2/1987 | Bober | 493/444 |
| 4,905,977 | A * | 3/1990 | Vijuk | 270/45 |
| 4,985,013 | A * | 1/1991 | van der Werff et al. | 493/444 |
| 5,090,671 | A * | 2/1992 | Gombault et al. | 270/45 |
| 5,092,833 | A | 3/1992 | King et al. | |
| 5,242,364 | A * | 9/1993 | Lehmann | 493/8 |
| 6,132,352 | A | 10/2000 | Rider | |

FOREIGN PATENT DOCUMENTS

| | | |
|---|---|---|
| DE | 198 28 625 A | 1/1999 |
| DE | 198 43 872 A | 3/2000 |

* cited by examiner

*Primary Examiner*—Ren Yan
(74) *Attorney, Agent, or Firm*—Fay, Sharpe, Fagan, Minnich & McKee, LLP

(57) ABSTRACT

A folding apparatus for folding sheets of flexible sheet materials, which includes a feeding mechanism (11, 17) for feeding sheets of material, a folding mechanism including a pair of rollers (11, 13) having a nip (23) into which a sheet of material (7) is inserted to create a fold (7*b*), and an inserter mechanism (21) for inserting a sheet (7) into the nip (23). The inserter mechanism (21) includes knife element (29) having an edge (31) that is arranged to engage a sheet (7) along a designated fold line (7*a*) and to insert said sheet (7) into the nip (23) to produce a fold (7*b*) along said fold line (7*a*). The inserter mechanism (21) is constructed and arranged to insert the sheet (7) into the nip (23) while the sheet (7) is positively engaged by the feeding mechanism (11, 17).

23 Claims, 11 Drawing Sheets

FOLDING APPARATUS AND METHOD

The present invention relates to a folding apparatus and method. The apparatus and method can be used to fold flexible sheet materials and in particular to fold paper and paper like materials containing printed matter.

Traditional printing techniques such as letterpress and offset litho deposit a thin film of ink on the surface of a stock material. The ink is absorbed by the stock material leaving an indelible mark. In contrast to traditional printing techniques, the Xerography approach used by modern digital print engines is a dry process in which a powder is deposited on the surface of the media to be printed. The powder is bonded to the surface of the media, which is commonly paper, by for example, a heating process. The control of the deposition of powder on the stock material to form words and pictures is typically performed automatically by a computer system.

Digital printing machines have several advantages over the offset litho machine. For example, the offset litho setup process is long requiring plates to be made by a skilled technician, and the printed stock requires time to dry before it can be finished. Comparatively, digital printing machines have very short setup times, no ink drying time and require a lower level of skill to operate the digital printing process. The fastest growing area in the print industry is for on demand short runs of high quality full colour printing. This is currently best satisfied by digital printing machines The current finishing equipment available to the digital printing market sector, such as folding and creasing machines have been developed for printed matter produced by traditional printing techniques. This type of equipment is unable to handle digitally printed matter without damaging it. For example, high quality digitally produced print requires the use of specially treated paper or card stock material. This type of paper is of such a quality that it is extremely sensitive to marking when articles scrape the surface and to cracking when folded or creased. Also, the toner on the surface of the paper is a brittle layer with a very low elastic limit that breaks when it is subjected to the tensile stresses created in the bending process by existing folding machines. When broken the toner loses its adhesion and flakes off.

One type of existing folding machine is a buckle folder which has buckle plates for guiding the stock material through the folding machine. These are usually set at about 45° to the paper path and include an end stop. The paper is fed between the buckle plates by rollers and collides with the end stop which causes the paper to buckle towards a nip formed by a pair of fold rollers. The paper is caught in the nip between the fold rollers which exert a force on the paper to create a permanent fold. This type of folding machine causes extensive marking on stock materials appropriate for digital print engines. Also, the position of the fold is not closely controlled and can vary with the type of paper stock used and the atmospheric conditions. This type of machine has to operate continuously at a constant speed otherwise the folding process becomes unpredictable.

Another type of folding machine known in the art is a knife folding machine. A piece of paper is fed on a conveyer above fold rollers until it collides with an end stop, halting the movement of the paper. A knife then pushes the paper into the nip between folding rollers. This is a static process since the sheet material has to be stationary before the knife directs the paper into the nip between the folding rollers.

With this type of machine stock material suitable for digital print engines is often marked when the paper hits the end stop, when the paper is grabbed by the folding rollers and in particular when the knife engages the paper. The position of the fold is not tightly controlled since the sheet of paper is not held in position as the folding blade acts on it.

In each of the folding machines described above, fold rollers are used to fold sheets into the required form. Fold rollers typically have a diameter of around 30–40 mm and in the folding process the sheet being folded can be wrapped up to half way round the roller. The stock material used by digital print engines is usually thicker than stock material used by conventional printing techniques. This means that the strain in the surface of the digitally printed media is greater than in traditional stock material which exacerbates the toner and paper surface cracking problem, exposing one or more layers of the materials construction. This is commonly referred to as 'white show through'.

The present invention seeks to provide an improved folding apparatus and method.

According to one aspect of the present invention there is provided a folding apparatus for folding sheets of flexible sheet materials, the apparatus including a feeding mechanism for feeding sheets of material, a folding mechanism including a pair of rollers having a nip into which a sheet of material is inserted to create a fold, and an inserter mechanism for inserting a sheet into the nip, said inserter mechanism including a knife element having an edge that is arranged to engage a sheet along a designated fold line and to insert said sheet into the nip to produce a fold along said fold line; wherein said inserter mechanism is constructed and arranged to insert the sheet into the nip while the sheet is positively engaged by the feeding mechanism.

In normal operation, the sheet material moves continuously throughout the folding process and therefore the folding apparatus folds sheet materials dynamically and the knife acts as a dynamic deflector. In particular, the feeding mechanism controllably feeds the sheet of paper along a feed path where it can be engaged by the knife element. The dynamic folding process significantly reduces the amount of damage caused to the sheet materials by avoiding the dragging action of some traditional devices.

Advantageously the inserter mechanism is constructed and arranged such that during the insertion operation there is substantially no relative movement between the knife edge and the region where it contacts the sheet. Preferably this is achieved by matching the position of the knife edge with the rotational position of the rollers, and hence the position of the sheet of paper. The position of the sheet and the position of the knife edge are controlled by a control system that takes into account the geometry of the paper feed path, the rollers and the knife to ensure that there is no substantial relative movement between the knife edge and the sheet of paper, in the region of contact, when the knife edge is engaged with the sheet. This arrangement leads to a reduction in the amount of damage to the paper as it passes through the folding apparatus.

Advantageously in one embodiment the knife element moves in a direction having a component of movement in the feed direction of the sheet material. Preferably the knife element moves rotationally and translationally. In one embodiment the knife edge moves in a curved path and preferably the centre of curvature of the curved path is adjustable. In general, the knife edge follows a path such that the distance between the knife edge and a first fold roller decreases as the knife edge inserts the sheet into the nip.

Preferably the pairs of rollers are arranged such that the sheet material is gripped by at least one pair of rollers throughout the folding process to accurately control the position of the sheet. The folding apparatus also includes a sensor for sensing an initial position of a sheet, which is preferably an optical sensor, and a control device for determining the position of the sheet according to the rotational position of the rollers. The control device controls the rotation of the rollers, and hence the position of the sheet of paper, via an incrementally controlled motor, for example, a stepper motor, servo motor or brushless DC motor.

In one embodiment the feed mechanism includes a fold roller that co-operates with a feed roller. This is an efficient arrangement which reduces the number of components required.

Preferably the sheet feed direction and the insertion direction for each folding mechanism are substantially perpendicular. It is also preferred to use fold rollers which have a diameter in the range 50 to 80 mm, which is larger than conventional folding machines. It has been found that a 50 mm diameter roller is best suited for providing the minimum acceptable fold length, whereas an 80 mm diameter roller is best suited for influencing paper curl and toner surface cracking. A roller having a 60 mm diameter has been found to offer a good compromise for these requirements.

Advantageously the knife element includes profiled surfaces arranged to guide the sheet material towards the folding means.

Advantageously the distance between at least one pair of rollers can be adjusted automatically. Alternatively, the distance between at least one pair of rollers can be adjusted manually.

Preferably the folding apparatus includes a first folding mechanism for producing folds in one direction (i.e. on one side of a sheet), and a second folding mechanism for producing folds in a second direction (i.e. on the second side of a sheet), which is constructed and arranged to receive a sheet fed to it from the first folding mechanism. The folding apparatus can also include subsequent folding mechanisms which are preferably arranged in series with the first and second folding mechanisms. For example, a folding apparatus having four folding mechanisms can be arranged such that the first and third folding mechanisms produce folds in a first direction and the second and fourth folding mechanisms produce folds in a second direction.

According to another aspect of the present invention there is provided a method of folding sheets of flexible sheet materials comprising the steps: feeding a sheet with a feeding mechanism towards a folding mechanism that includes a pair of fold rollers which form a nip and an inserter mechanism, said inserter mechanism having a knife element including a knife edge; moving the knife element such that the knife edge engages the sheet along a predetermined fold line; inserting the sheet with the inserter mechanism into the nip; and folding the sheet material along the predetermined fold line with the fold rollers; wherein, as the sheet is inserted into the nip, the sheet is positively engaged by the feeding mechanism.

Preferably the method includes the additional step of gripping the sheet by at least one pair of rollers throughout the folding process.

Advantageously during insertion of the sheet into the folding mechanism there is no substantial relative movement between the knife edge and the sheet in the region of contact.

Preferably the knife edge moves in a curved path.

Preferably the knife element moves in a direction having a component of movement in the feed direction of the sheet.

Advantageously the sheet is detected by a sensor at the known starting position and preferably the sensor detects at least one of the leading and trailing edge of the sheet. The position of the sheet within the apparatus is determined according to the distance the sheet has been fed relative to a known starting position.

Advantageously actuation of the inserter mechanism is controlled according to the position of the sheet material within the apparatus. Preferably, the actuation of the inserter mechanism is controlled according to the position of at least one of the edges of the sheet material within the apparatus, for example, the leading edge.

An embodiment of the present invention will now be described, by way of example only, with reference to the accompanying drawings in which like references indicate equivalent features, wherein.

Figure 1:
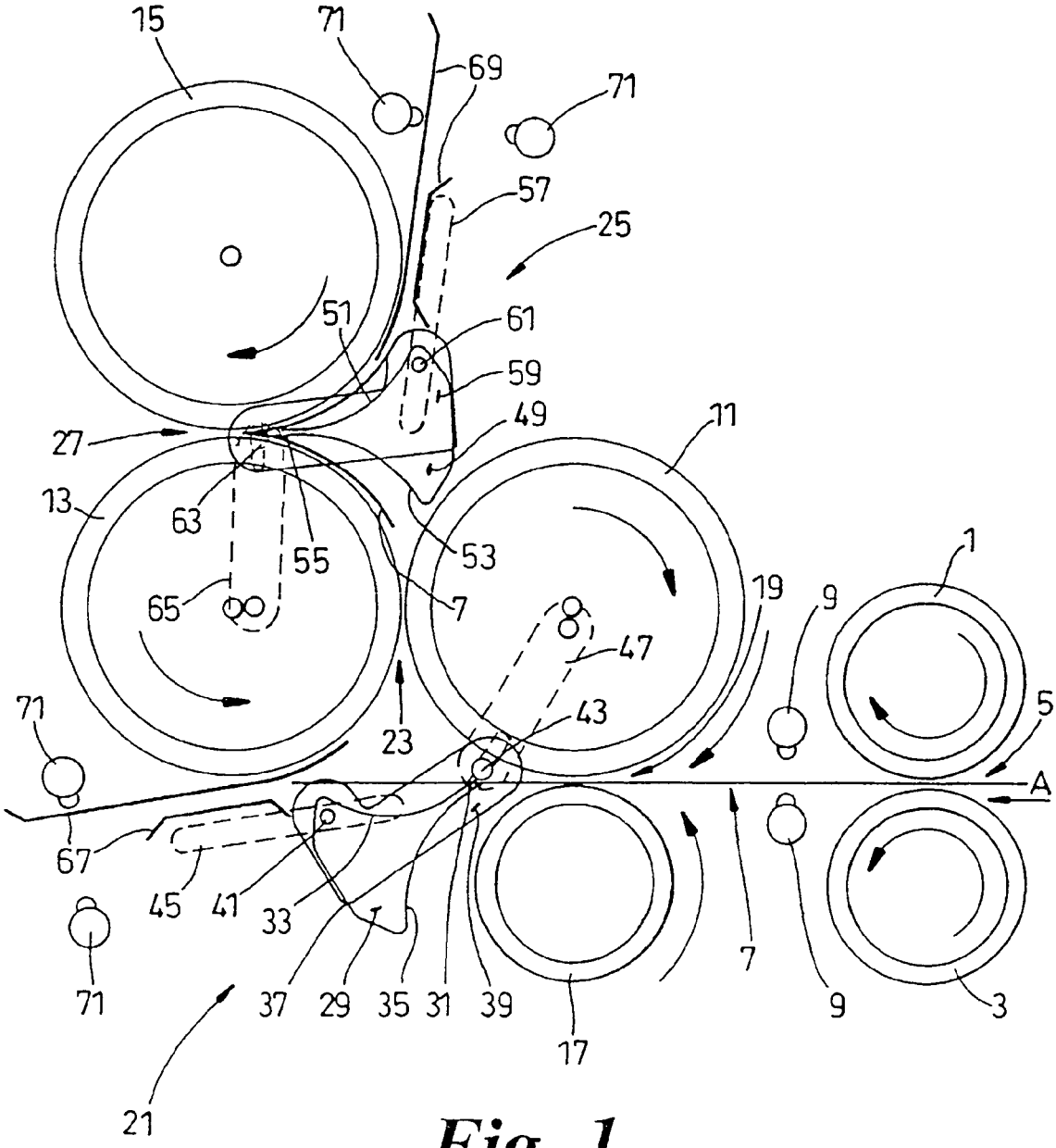
FIG. 1 is a schematic side view of an embodiment of the present invention.
Figure 2:
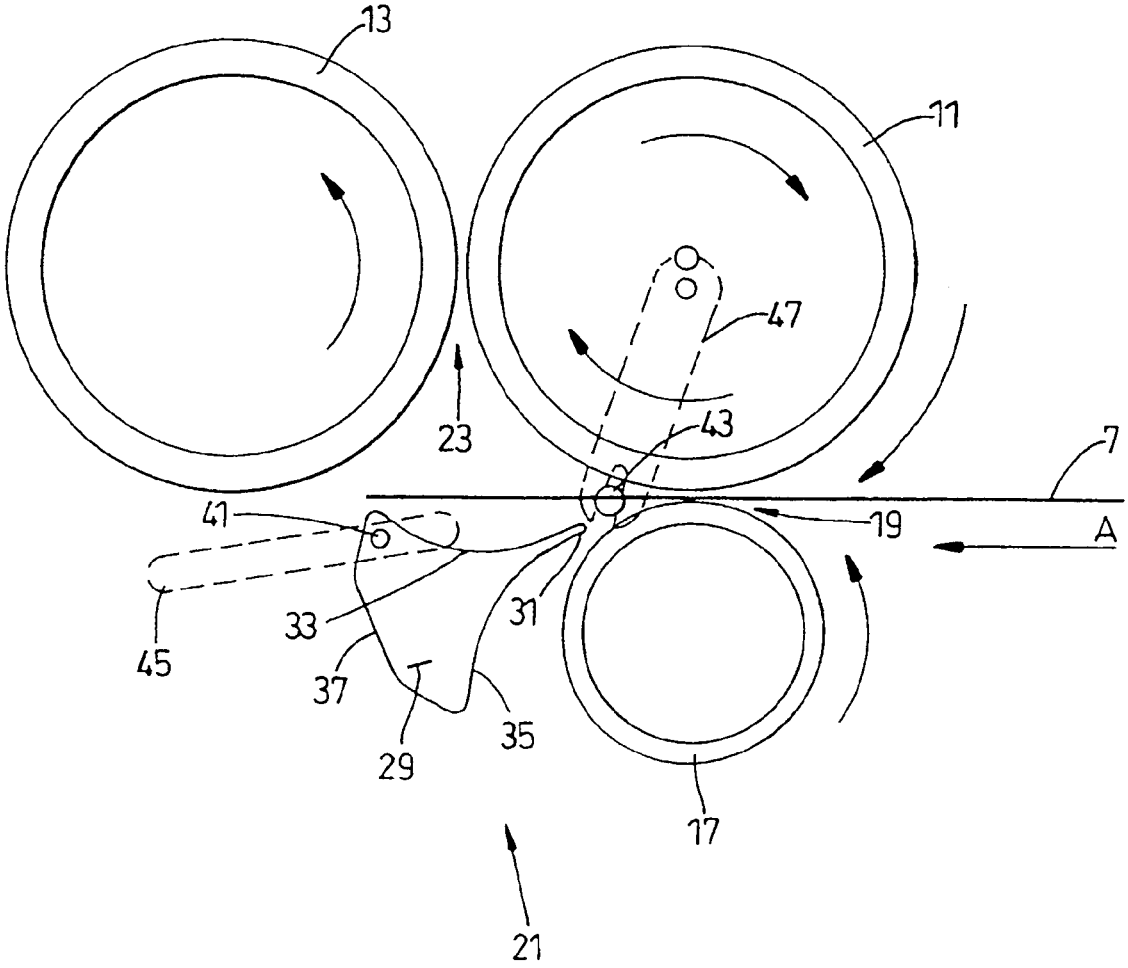
FIGS. 2 to 7 are schematic side views showing the consecutive steps of a first folding operation.
Figure 3:
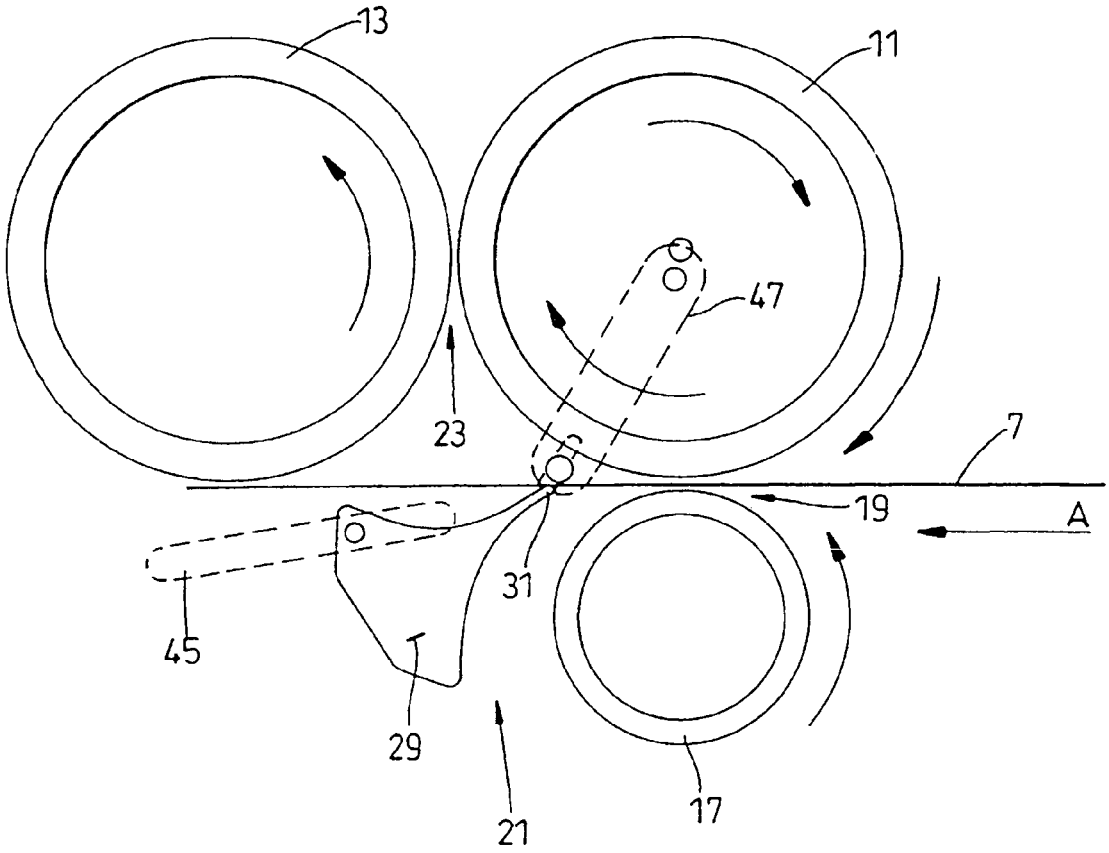
Figure 4:
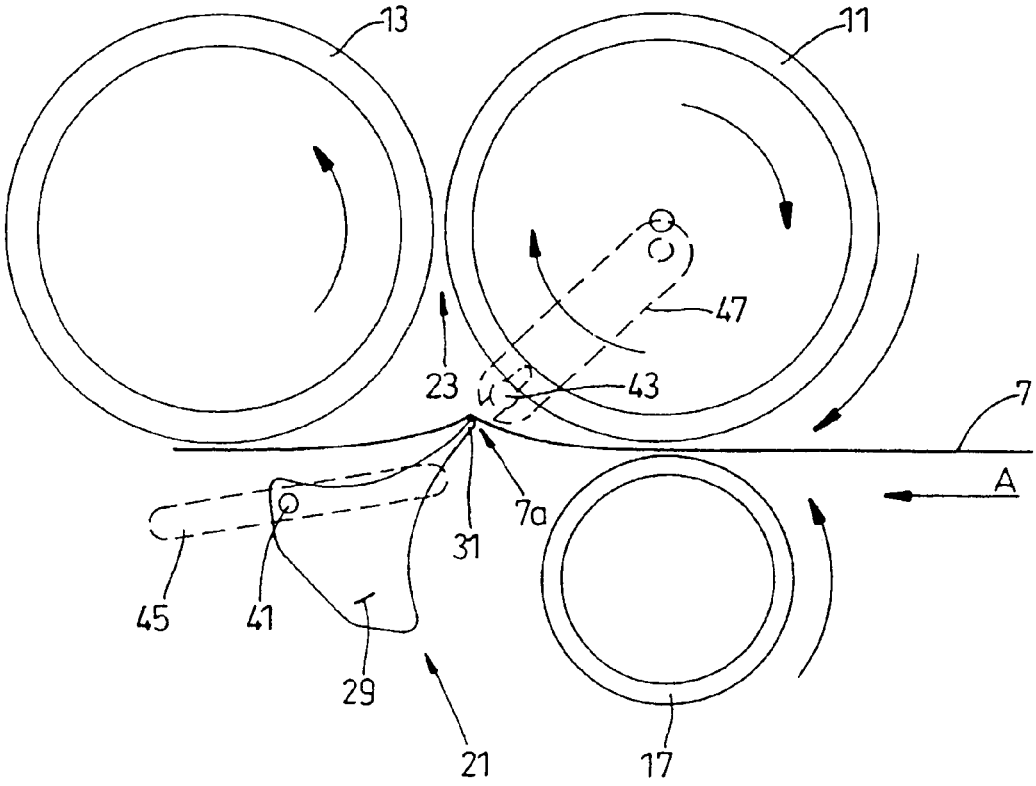
Figure 5:
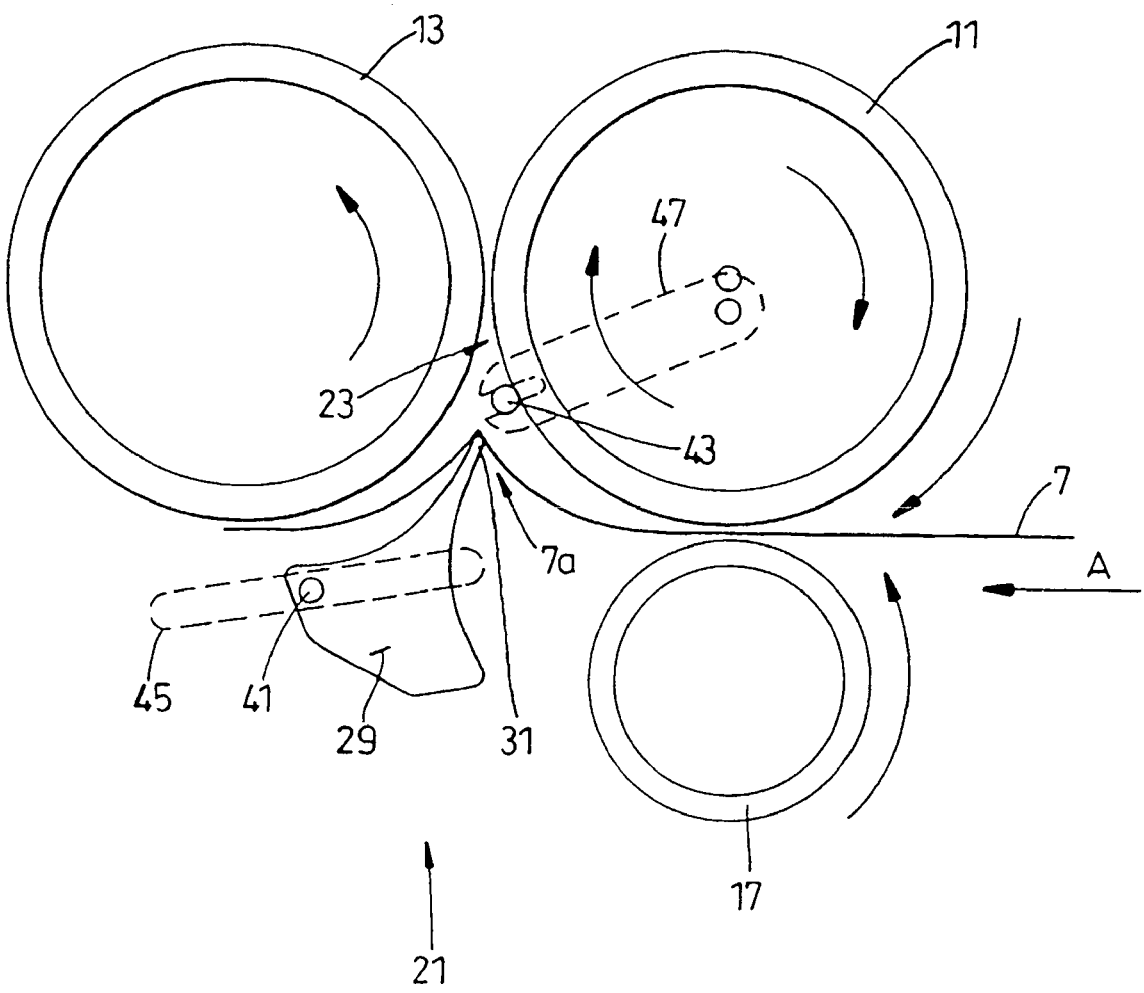
Figure 6:
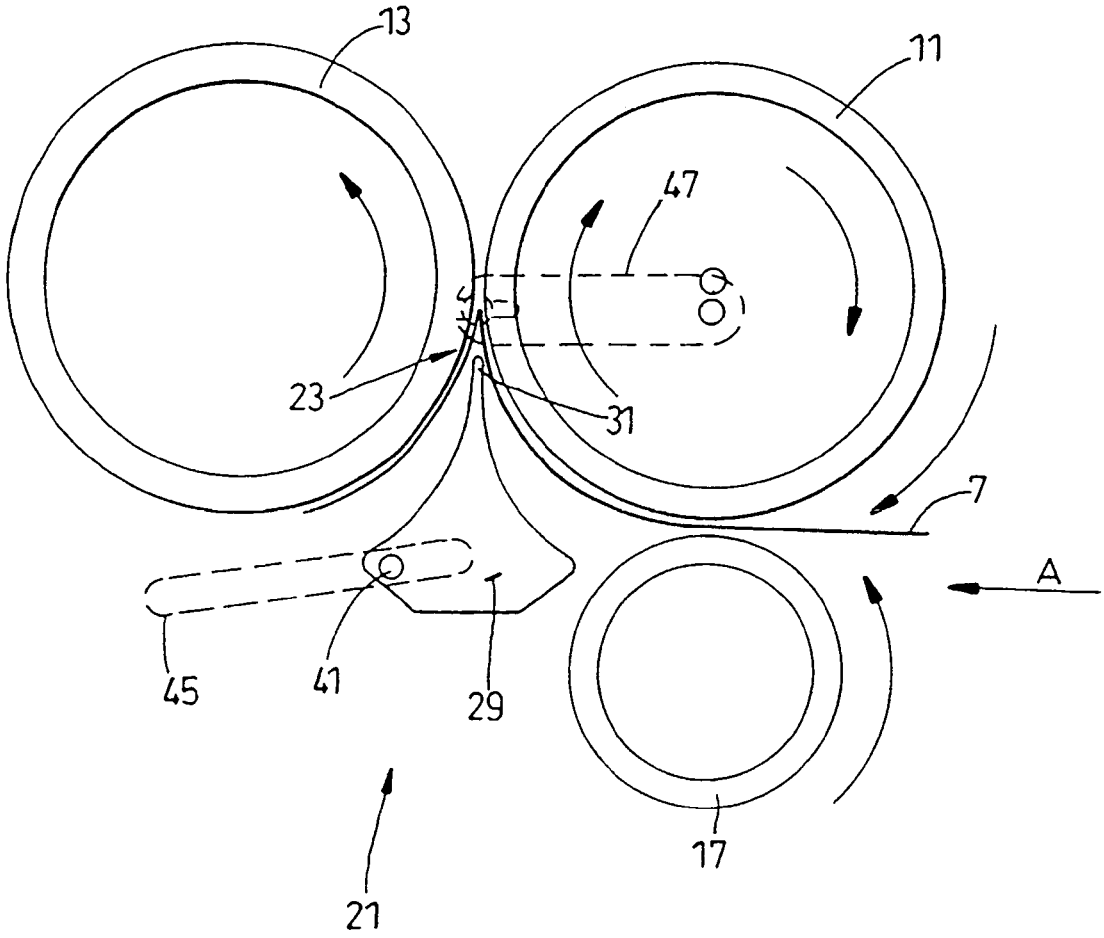

FIG. 1 shows a folding machine having upper and lower contra-rotating input rollers 1, 3 arranged in parallel and in close proximity to one another such that the curved surfaces of the input rollers 1, 3 form a first nip 5. The input rollers 1, 3 are arranged to receive a sheet of paper 7 from a supply mechanism (not shown) and to feed the sheet of paper 7 horizontally along a feed path to a folding mechanism.

Downstream of the first nip 5 is a sensor 9 which detects the leading edge of a sheet of paper 7 as it travels alone the feed path. Alternatively, the sensor 9 can be arranged to detect the trailing edge of a sheet of paper 7. Preferably the sensor 9 is an optical sensor having a light transmitting element below the paper feed path and a light detecting element above the paper feed path.

Downstream of the sensor 9 are first, second, and third fold rollers 11, 13, 15 and a fold input roller 17.

The first fold roller 11 and the fold input roller 17 are arranged in parallel and in close proximity such that the curved surfaces of the rollers 11, 17 form a second nip 19 which is arranged to receive a sheet of paper 7 from the input rollers 1, 3 and then feed the sheet of paper 7 substantially horizontally towards a first inserter mechanism 21. The diameter of the fold input roller 17 is typically in the range 30–60 mm.

The first and second fold rollers 11, 13 are arranged in parallel and in close proximity such that the curved surfaces of the fold rollers 11, 13 form a third nip 23, which is arranged to feed a sheet of paper 7 vertically towards a second inserter mechanism 25. The second and third fold rollers 13, 15 are arranged in parallel and in close proximity such that the curved surfaces of the fold rollers 13, 15 form a fourth nip 27, which is arranged to feed a sheet of paper 7 horizontally. The diameters of the first, second and third fold rollers are substantially equal and are preferably in the range approximately 50 to 80 mm, for example 60 mm.

The distance between the operational pairs of rollers (commonly known as 'roller gap') at each nip 5, 19, 23, 27 is in the range 0–3 mm, and is determined by the thickness and number of layers of the paper 7 expected to pass through each particular nip.

The rollers 1, 3, 11, 13, 15, 17 are interlinked by a gear mechanism and are driven by a stepper motor to rotate with the same tangential speed at the curved surfaces of the rollers. The stepper motor is controlled by a microprocessor which receives information from a rotary encoder that is mounted on either the motor or one of the rollers to monitor the true rotational position of the rollers. The upper input roller 1, the first fold roller 11 and the third fold roller 13 rotate in a first direction (clockwise in FIG. 1), while the lower input roller 3, the fold input roller 17 and the second fold roller 13 all rotate in a second direction (anti-clockwise in FIG. 1). The drive direction of the rollers can be reversed, for example, to clear miss-feeds or paper jams, but this is not done during normal operation. Use of a stepper motor and the associated control system enables the exact rotational position of the rollers, and hence the sheet of paper 7, to be known.

The first inserter mechanism 21 is arranged to insert a sheet of paper 7 into the third nip 23 formed by the first and second fold rollers 11, 13. The second inserter mechanism 25 is arranged to insert a sheet of paper 7 into the fourth nip 27 formed by the second and third fold rollers 13, 15.

The first inserter mechanism 21 includes a blade 29 having a substantially triangular section, a blade edge 31 and two concave guide surfaces 33 and 35 which extend from the blade edge 31 towards a convex base 37. Preferably the blade 29 has a high stiffness and a low inertia.

At each end, the blade 29 is attached to a blade carrier 39. The blade carrier includes an L shaped plate which extends from the knife base 37 beyond the blade edge 31. Each blade carrier 39 is supported by two pins 41, 43. The first pin 41 is positioned towards the rear edge of the blade carrier 39 and is located for free sliding movement in a blade slide 45, which is positioned below the second fold roller 13. The second pin 43 is located on the blade carrier 39 ahead of the blade edge 31 and is attached by means of a pivot link to the free end of a rotatable blade drive 47.

The blade drive 47 is mounted at its opposite end for rotation about an axis of rotation that is located slightly below the axis of rotation of the first fold roller 11 such that when the blade drive 47 rotates, the blade edge 31 follows a curved path into the third nip 23 formed by the first and second fold rollers 11, 13, converging towards a point substantially equidistant between the first and second fold rollers 11, 13.

The second inserter mechanism 25 is similar to the first inserter mechanism 21 and includes a blade 49 having concave guide surfaces 51 and 53 and a blade edge 55, a blade slide 57, a blade carrier 59 having a first pin 61 located in a longitudinal slot in the blade slide 57 and having a second pin 63 rotatably attached to a blade drive 65. The second inserter mechanism 25 is arranged such that the blade edge 55 follows a curved path into the fourth nip 27 formed by the second and third fold rollers 13, 15.

The components in the second stage folding apparatus are substantially the same as equivalent components in the first folding stage.

The first and second inserter mechanisms 21, 25 are driven simultaneously by a blade drive stepper motor. Operation of the first and second inserter mechanisms 21, 25 is 180 degrees out of phase such that as the blade edge 31 of the first inserter mechanism 21 moves towards the third nip 23 formed by the first and second fold rollers 11, 13 from the home position, the blade edge 55 of the second inserter mechanism 25 moves away from the fourth nip 27 formed by the second and third fold rollers 13, 15. The blade drive stepper motor does not rotate continuously in one direction but rather reverses direction to alternately drive the blade edge 31 of the first inserter mechanism 21 towards the third nip 23 and the blade edge 55 of the second inserter mechanism 25 towards the fourth nip 27.

The sensor 9, the roller drive stepper motor and the blade drive stepper motor are linked to a control unit (not shown) which controls the speed and direction of rotation of both motors, and synchronises the operation of the inserter mechanisms with the rotation of the rollers 1, 3, 11, 13, 15, 17.

Additionally, the folding machine includes a number of guide plates. These include, a first pair of guide plates 67 located beneath the second fold roller 13 to receive, guide and support a sheet of paper 7 fed through the first nip 5 formed by the first fold roller 11 and the fold input roller 17. A second pair of guide plates 69 is located above the third nip 23 formed by the first and second fold rollers 11, 13 to receive, guide and support a sheet 7 fed between the rollers 11, 13.

Optionally, the folding machine may also include additional sensors to sense paper jams and, if necessary, to re-synchronise operation of the inserter and fold rollers. For example, in the mechanism shown in FIG. 1, additional sensors 71 are provided along the paper feed path after the first inserter mechanism 21 and after the second inserter mechanism 25.

The operation of the folding machine will now be described with reference to FIGS. 2 to 7 which show a simplified version of the folding machine having only one pair of fold rollers 11, 13 and one inserter mechanism 21. The input rollers 1, 3 and the paper sensor 9 have been omitted for clarity.

The gap between each operational pair of rollers, for example, the first and second fold rollers 11, 13 or the first fold roller 11 and the fold input roller 17, is typically set before the folding process begins and may be set manually or by automatic means. Alternatively, the gap between operational pairs of rollers may be altered dynamically during the folding process by detecting the thickness of the stock material 7 being fed into the apparatus and adjusting the gap between the rollers automatically. In any case, the gap between the rollers is such that operational pairs of rollers can grip the paper 7 without damaging the printed surface of the paper 7.

A sheet of paper 7 is received by the upper and lower input rollers 1, 3 from a feeding mechanism and is controllably fed along a horizontal feed path to the second nip 19 via the sensor 9. The sensor 9 detects the leading edge of the sheet of paper 7 and sends a signal to the microprocessor control unit which synchronises the rotation of the rollers, and operation of the inserter mechanism, to the position of the sheet of paper 7.

The sheet of paper 7 is received at the second nip 19 by the first fold roller 11 and the fold input roller 17 before it is released from the grip of the upper and lower input rollers 1, 3, to ensure that the position of the sheet 7 is known as it moves through the mechanism. The first fold roller 11 and the fold input roller 17 feed the sheet of paper 7 along a horizontal path which is below the first and second fold rollers 11, 13 and is substantially perpendicular to axes of rotation of the first and second fold rollers 11, 13.

Initially, the blade 29 of the inserter mechanism 21 is in a home position which is located below the paper feed path. In this position the blade drive 47 is at the anti-clockwise limit of its range of movement. The blade edge 31 is arranged parallel to the axes of rotation of the first and second fold rollers 11, 13.

When the sheet of paper 7 has reached the position where a fold is to be formed the blade drive 47 rotates clockwise, drawing the blade edge 31 into the third nip 23 between the fold rollers. The rotation of the rollers, and hence the movement of the sheet of paper 7, is synchronised with the movement of the blade 29, and the blade edge 31 is driven into engagement with the sheet of paper 7 along a predetermined fold line 7*a*. This is achieved by controlling the position of the paper 7 and/or the position of the blade 29. In particular, the position of the blade edge 31 is matched to the position of the paper 7, and hence the rotational position of the rollers, to ensure that there is substantially no relative movement between the blade edge 31 and the paper 7 in the region of contact 7*a*. This avoids marking the printed surface of the paper.

This can be achieved, for example, by reducing the speed of the rollers, and hence the paper feed speed, as the blade 29 accelerates such that when the blade edge 31 engages the paper 7, the blade edge 31 is travelling at substantially the same speed as the paper 7. The relationship between the paper speed and blade speed is however dependent only on the geometries of the blade and roller and once established does not subsequently have to be adjusted for that particular blade and roller combination.

The blade edge 31 travels along an accurate path that converges with the third nip 23 formed by the first and second fold rollers 11, 13. The motion of the blade 29 is accommodated by linear reciprocating motion of the pin 41 along the slot in the blade slide 45 and by rotation of the blade 29 about pin 41 (see, for example, FIG. 4).

As the blade 29 rotates anti-clockwise the blade edge 31 rises above the feed path of the paper, engaging the sheet 7 along a predetermined line 7*a*, and lifting the sheet 7 upwards towards the third nip 23. As the blade 29 rotates the sheet of paper 7 starts to fold about the blade edge 31.

The combined effect of the linear and rotational motion of the blade 29, locates the blade edge 31 in a position substantially in line with the third nip 23 and substantially perpendicular to the direction of the paper feed path as indicated by the arrow A, wherein the blade edge 31 is adjacent to the third nip 23 and equidistant between the first and second fold rollers 11, 13. This position represents the maximum height position of the blade edge 31 (see FIG. 6). The distance between the blade edge 31 and the first and second fold rollers 11, 13 in the maximum height position can be controlled according to properties of the paper 7 being folded, in particular the thickness dimension of the paper 7, and the gap between the first and second fold rollers 11, 13.

Figure 7:
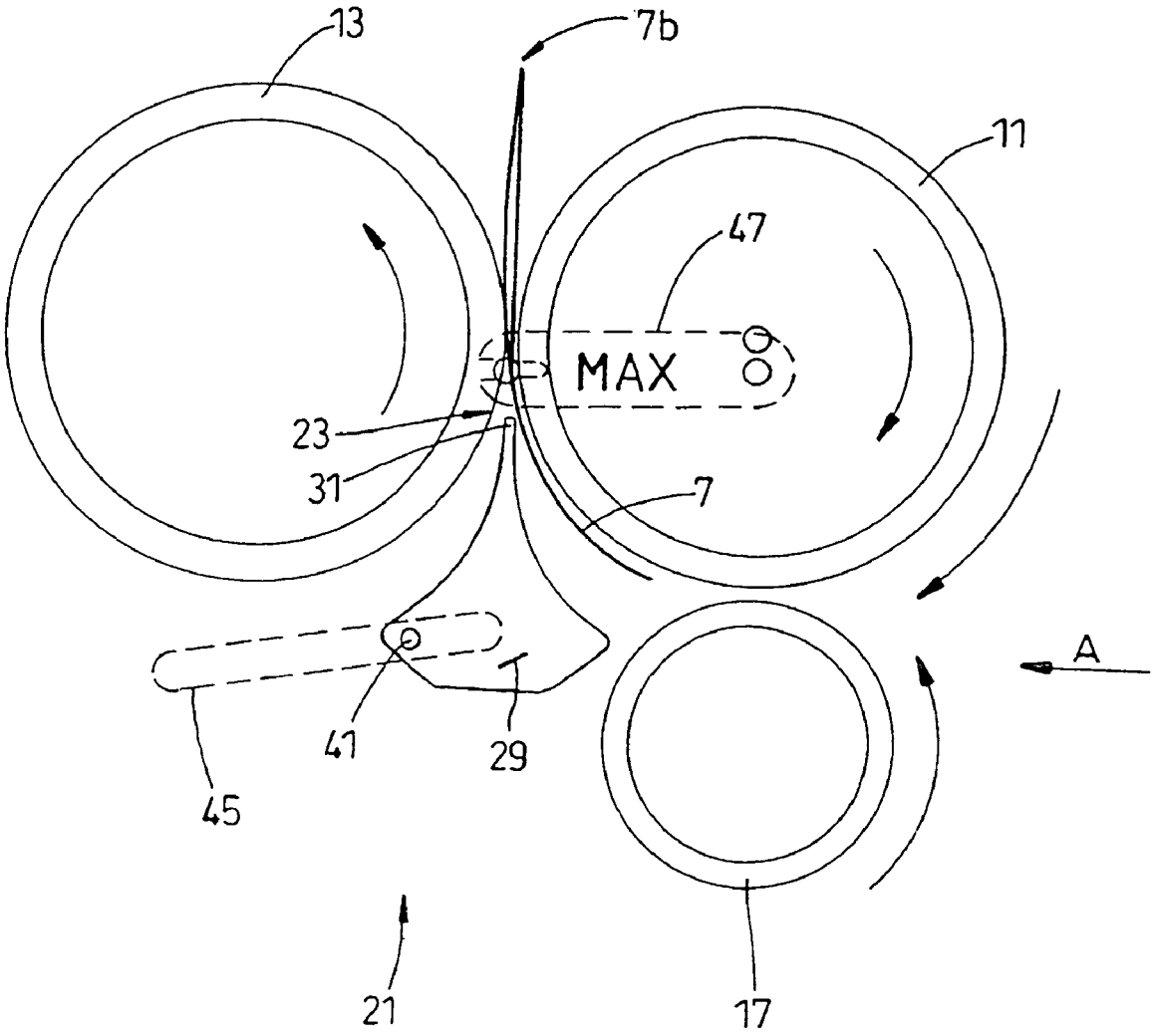
Figure 8:
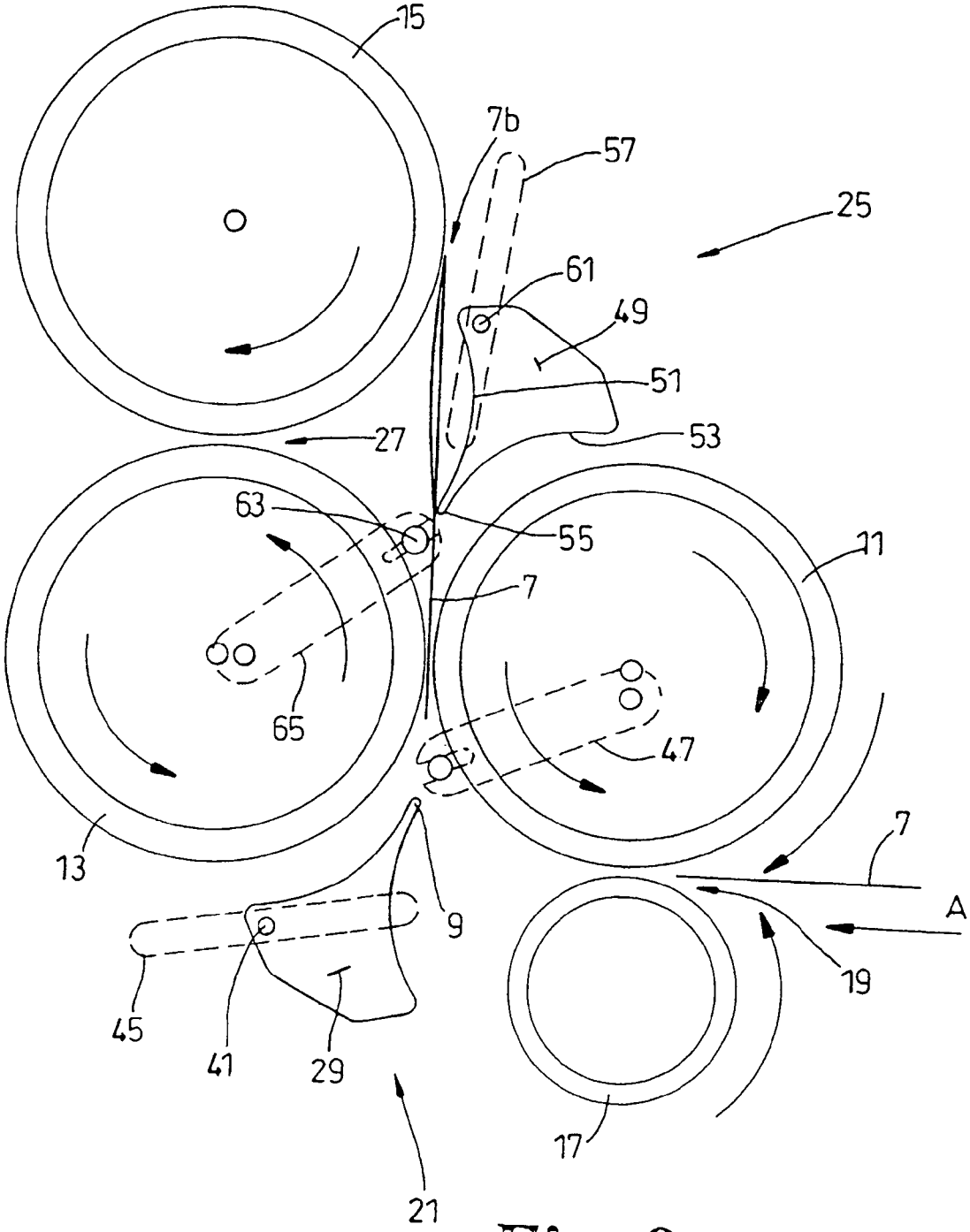
FIGS. 8 to 11 are schematic side views showing the consecutive steps of a second folding operation.
Figure 9:
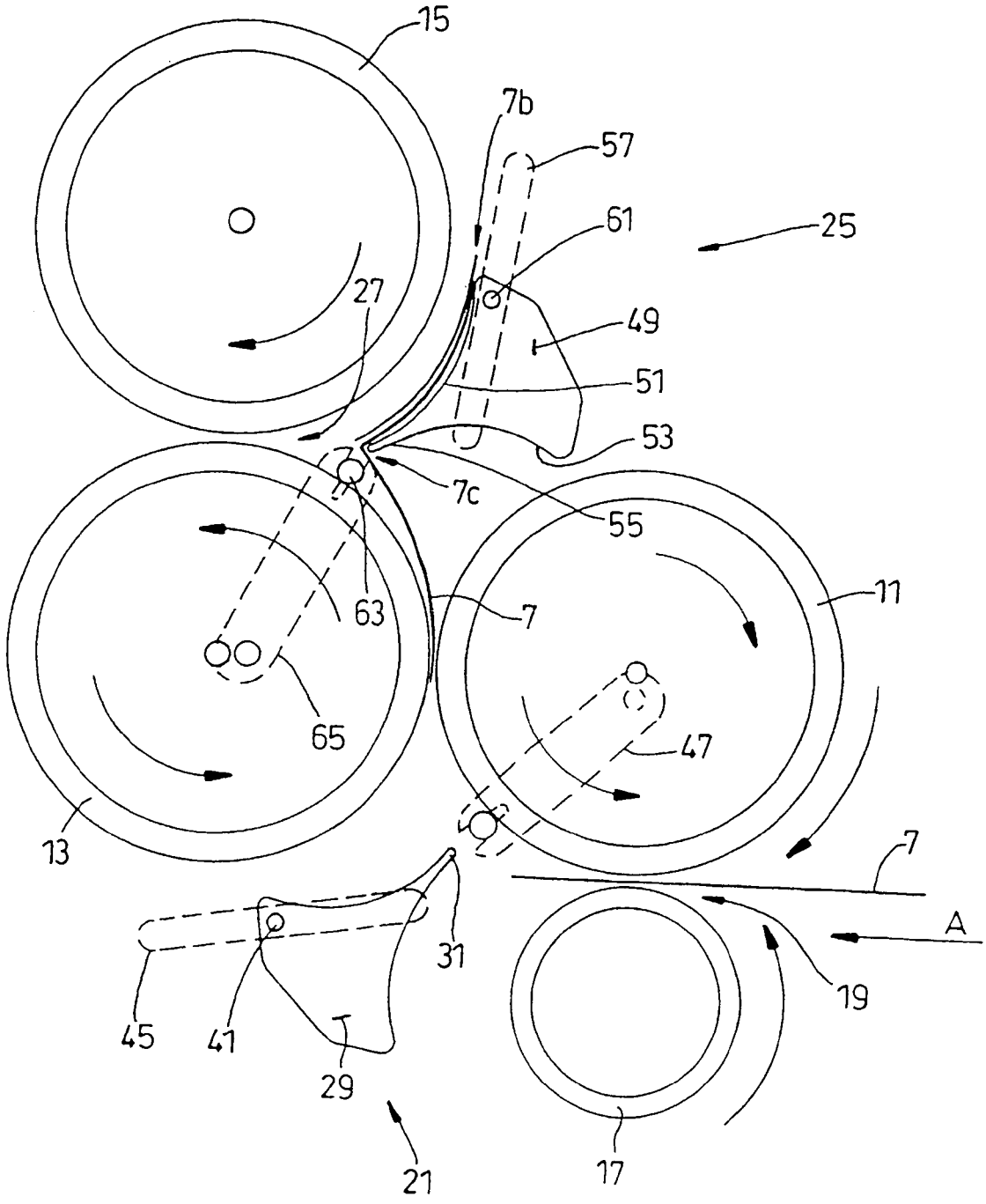

When the blade edge 31 reaches, or substantially reaches, the maximum height position the sheet of paper 7 is engaged by the first and second fold rollers 11, 13 and is drawn into the third nip 23 (see FIG. 7). The first and second fold rollers 11, 13 create a permanent fold 7*b* in the paper 7 substantially along the predetermined fold line 7*a*.

Whilst the blade edge 31 remains engaged with the sheet of paper 7 the position of the blade edge 31 is matched to the rotational position of the rollers, and hence the position of the paper 7, by the control system via the stepper motors such that there is no relative movement between the sheet of paper 7 and the blade edge 31 in the region of contact 7*a*. The blade edge 31 moves continuously with the paper 7 and thus provides a dynamic folding process. This has the effect of considerably reducing the amount of damage caused to the surface of the paper 7 compared with traditional folding machines.

The relationship between the position of the blade edge 31 and the rotational position of the rollers, and hence the position of the paper 7, is a dependent upon the geometry of the paper feed path, the rollers and the knife.

Since position of the blade 29 is matched to the position of the paper 7 by the control system it is possible to change the paper feed speed without affecting the folding process. This includes fully stopping and restarting the process without adversely affecting the outcome. This is because the rollers grip the sheet of paper 7 throughout the folding process and thereby accurately control the position of the paper 7, and since the knife position is matched to the position of the sheet 7, if the paper feed speed is increased or decreased, the knife speed is increased or decreased in proportion.

After passing between the first and second fold rollers 11, 13 the paper 7 can be fed to a stacking unit and the blade 29 is returned to the home position by reversing the direction of the knife stepper motor and hence the rotational directions of the blade drive 47 and the blade 29.

In the home position, the blade 29 awaits reactivation by the detection of subsequent sheets of paper 7 by the sensing device 9. The rollers are still driven in their respective original directions during the blade 29 reversing operation since they are driven by a separate stepper motor.

Alternatively, after the sheet of paper 7 passes between the first and second fold rollers 11, 13, the paper 7 can be fed to a second (or subsequent) folding station to produce a second (or subsequent) fold 7*d* in the opposite direction (i.e. on the opposite side of the paper 7). This embodiment is shown in FIGS. 1 and 8 to 11. The second folding process is performed by the second and third fold rollers 13, 15. The folded sheet of paper 7 is guided into the fourth nip 27 by the second inserter mechanism 25.

The components of the second inserter mechanism 25 are described above, and the operation of the second inserter mechanism 25 is substantially in accordance with the first inserter mechanism 21. Therefore the remainder of this description will focus upon the operation of an embodiment of the present invention having two folding stages with reference to FIGS. 8 to 11.

The sheet of paper 7, having a permanent fold 7*b*, is drawn between the first and second fold rollers 11, 13 and the knife stepper motor is reversed driving the first stage blade 29 toward the home position and the second stage blade 49 into engagement with the sheet of paper 7 via the blade drive 65. The blade 49 engages the paper 7 with the blade edge 55 along a predetermined line 7*c* wherein a second (or subsequent) permanent fold 7*d* will be produced in the opposite direction by the second and third fold rollers 13, 15. The blade edge 55 engages the paper 7 such that there is no substantial relative movement between the paper 7 and the blade edge 55 in the region of contact 7*c*.

The blade 49 rotates in a clockwise direction driven by the blade drive 65 which rotates in an anti-clockwise direction. As the blade 49 rotates, the paper 7 folds about the blade edge 55 and is guided towards the fourth nip 27 formed by the curved surfaces of the second and third fold rollers 13, 15. The sheet of paper 7 is guided by the blade 49 substantially in accordance with the principle of operation of the blade 29 described above.

The blades 29 and 49 can provide a guiding function. This is achieved by the control system activating the blade so as to engage the sheet of paper 7 at or adjacent its leading edge (i.e. as though it were trying to place a fold on the leading edge of the sheet). The system works in the same manner as described above except that, due to the relative positions of the leading edge of the sheet and the blade edge 31, 55, a fold is not formed. Instead, the knife 29,49 simply guides the leading edge of the sheet into the nip 23,27 so that the sheet passes between the fold rollers without forming a fold in the sheet 7. For example, if only one fold is required, the blade 29 of the first inserter mechanism 21 can simply guide the sheet 7 through the first fold rollers 11, 13, without creating a fold, to the second inserter mechanism 25 which can insert the sheet 7 into the nip 27 so that the second and third fold rollers 13, 15 create a fold in the sheet.

Figure 10:
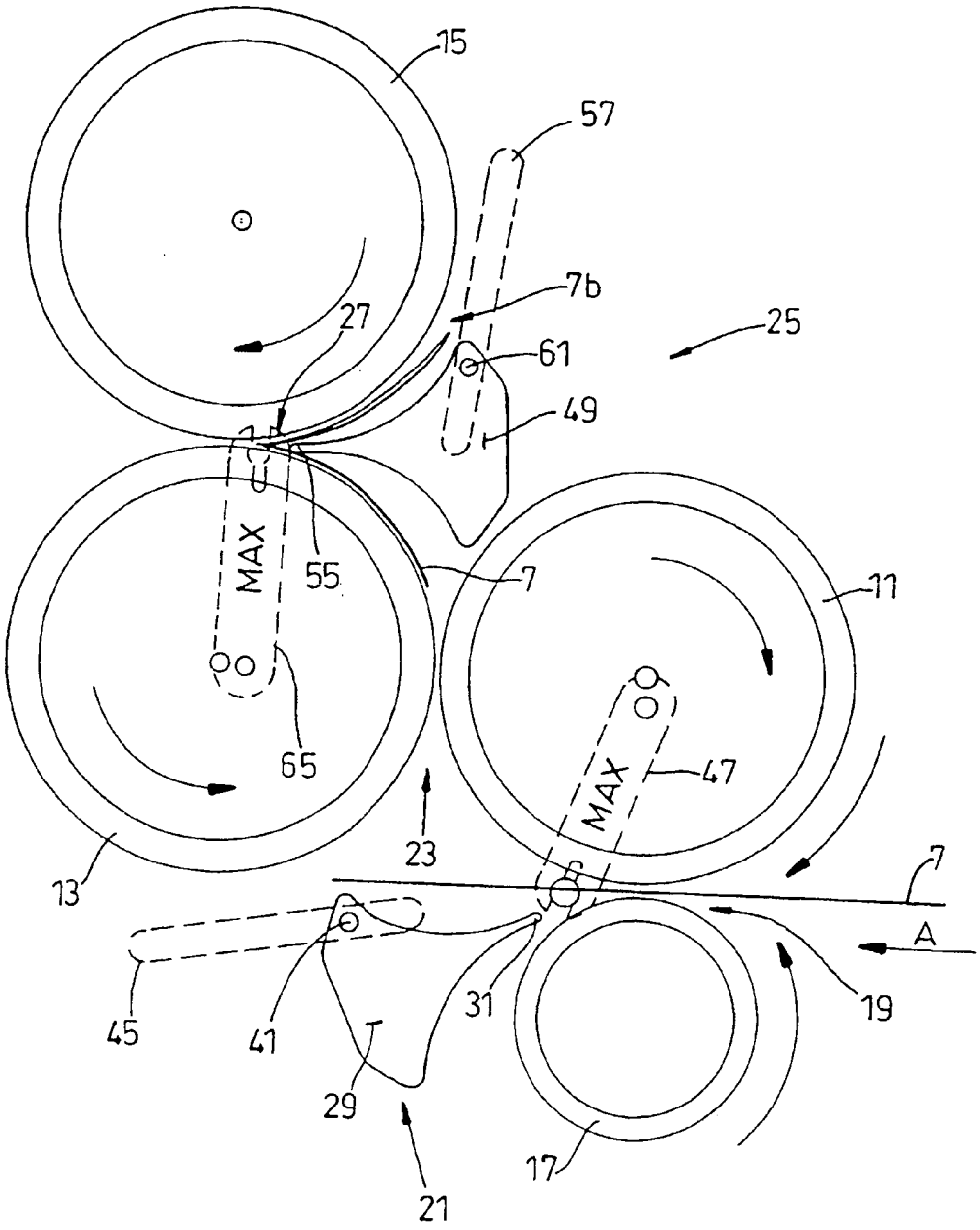
Figure 11:
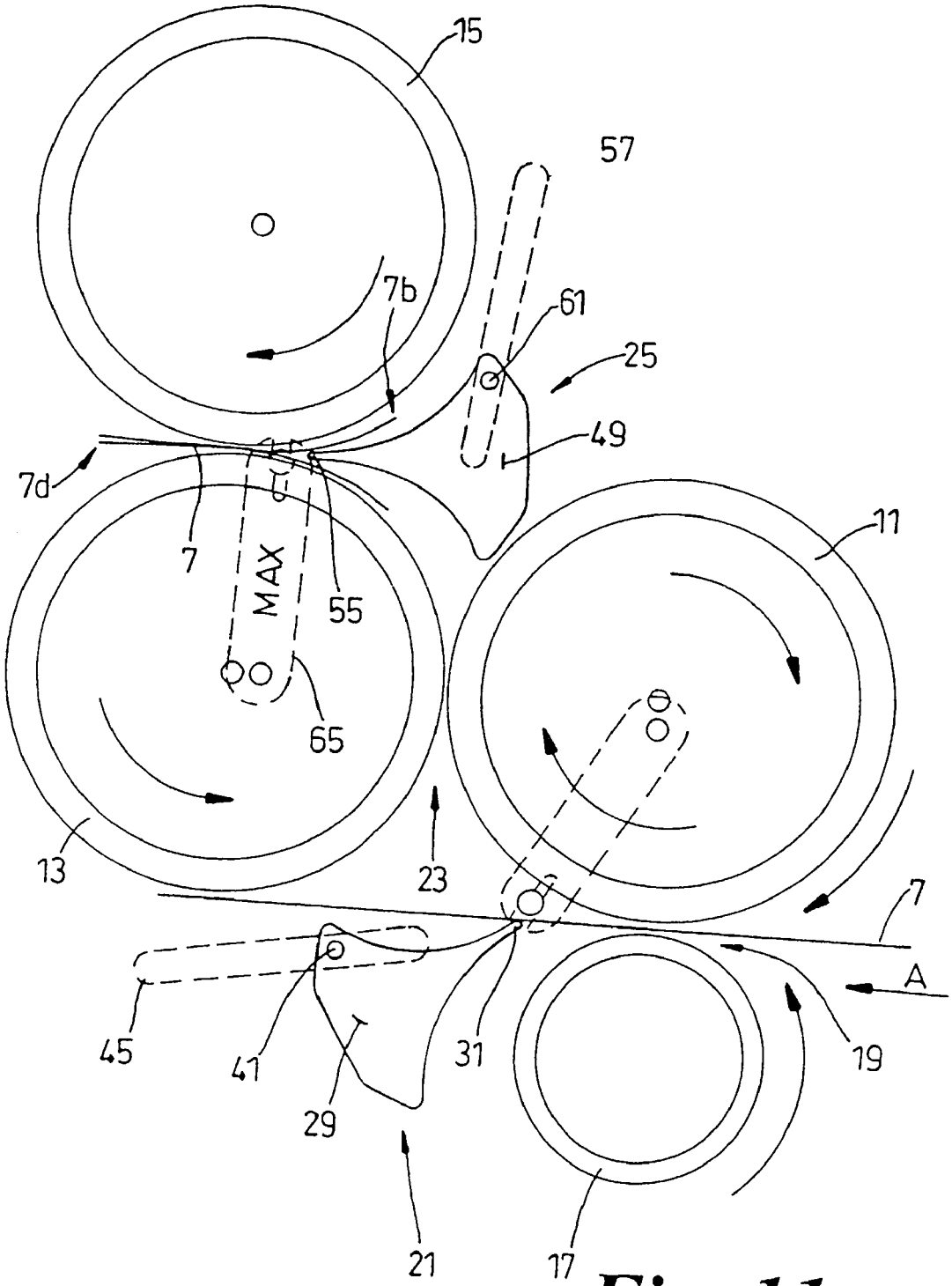

FIG. 10 shows that the first stage blade 29 is in its home position when the second stage blade edge 55 is in its maximum height position: Therefore a second sheet of paper 7 can travel through the first stage folding process as the first sheet of paper 7 is engaged by the second and third fold rollers 11, 15 at the fourth nip 27. As the first stage blade 29 moves from the home position towards engagement with the sheet of paper 7 the second stage blade 49 moves from the maximum height position towards its home position.

Additional folding mechanisms can be included in the folding apparatus, for example, the folding apparatus can be arranged to have three or four folding mechanisms. In general, the invention can include any practicable number of folding mechanisms.

The folding apparatus can be arranged for folding sheet material in a number of ways such as the so called 'Z' shape and 'V' shape folding techniques.

The folding apparatus control system is microprocessor based. In one embodiment the control system uses artificial intelligence techniques to set up and run the machine from data relating to the different types of fold that will normally be required by the operator. Advantageously, this reduces the skill level required to operate the folding apparatus, bringing the skills required by the operator in line with the skills required to operate other machines within digital print rooms.

It will be appreciated that alterations can be made to the embodiment described above without departing from the spirit of the present invention. For example, rollers can be arranged to rotate in opposite directions, the shape of the blade can be altered and the sheet material folded is not restricted to paper.

Also, the path of the blade 29 (and/or 49) can be changed from a curved path to a linear path. For example, the blade 29 can move diagonally towards the first and second fold rollers 11, 13 at some angle relative to the direction of flow of the paper 7 as indicated by arrow A. Preferably the blade 29 has a component of motion in the direction of movement of the sheet of paper 7 indicated by the arrow A, however, the invention is not limited to this feature, since the blade 29 can be arranged to move vertically into the third nip 23 with the first fold roller 11 and the fold input roller 17 feeding the sheet of paper 7 synchronously with the movement of the blade edge 31.

The invention claimed is:

1. A folding apparatus for folding sheets of flexible sheet materials, the apparatus including a feeding mechanism for feeding sheets of material, a folding mechanism including a pair of rollers having a nip into which a sheet of material is inserted to create a fold, and an inserter mechanism for inserting a sheet into the nip, said inserter mechanism including a knife element having an edge that is arranged to engage a sheet along a designated fold line and to insert said sheet into the nip to produce a fold along said fold line; wherein said inserter mechanism is constructed and arranged to insert the sheet into the nip while the sheet is positively engaged by the feeding mechanism, the knife edge is arranged to move along a curved path and the centre of curvature of the curved path is adjustable.

2. A folding apparatus according to claim 1, wherein the inserter mechanism is constructed and arranged such that during the insertion operation there is substantially no relative movement between the knife edge and the region where it contacts the sheet.

3. A folding apparatus according to claim 2, wherein the position of the knife edge is matched with the rotational position of the fold rollers, and hence the position of the sheet.

4. A folding apparatus according to claim 1, wherein the knife element moves in a direction having a component of movement in the feed direction of the sheet material.

5. A folding apparatus according to claim 1, wherein the knife edge follows a path such that the distance between the knife edge and a first fold roller decreases as the knife edge inserts the sheet into the nip.

6. A folding apparatus according to claim 1, wherein the pairs of rollers are arranged such that the sheet material is gripped by at least one pair of rollers throughout the folding process, to accurately control the position of the sheet material.

7. A folding apparatus according to claim 1, including a sensor for sensing an initial position of a sheet.

8. A folding apparatus according to claim 7, wherein the sensor is an optical sensor.

9. A folding apparatus according to claim 7, including a control device for determining the position of the sheet according to the rotation of the rollers.

10. A folding apparatus according to claim 1, wherein the feed mechanism includes a fold roller co-operating with a feed roller.

11. A folding apparatus according to claim 1, wherein the sheet feed direction and the insertion direction for each folding mechanism are substantially perpendicular.

12. A folding apparatus according to claim 1, wherein the knife element includes profiled surfaces for guiding the sheet material towards the folding means.

13. A folding apparatus according to claim 1, wherein the size of the gap between at least one pair of rollers can be adjusted automatically.

14. A folding apparatus according to claim 1, wherein the fold rollers have a diameter in the range 50 to 80 mm.

15. A folding apparatus according to claim 1, including a first folding mechanism for producing folds in a first direction, and a second folding mechanism for producing folds in a second direction, which is constructed and arranged to receive a sheet fed to it from the first folding mechanism.

16. A folding apparatus according to claim 1, wherein the fold rollers have a diameter of approximately 60 mm.

17. A folding apparatus according to claim 1, wherein the knife element is pivotally mounted in slides and is arranged for free sliding and pivotal movement within the slides, and wherein the centre of curvature of the curved path is adjustable by the knife element adjusting its position within the slides.

18. A folding apparatus according to claim 17, wherein the slides are located below the rollers in the folding mechanism.

19. A folding apparatus according to claim 1, wherein each end of the knife element is connected to a drive arm of a knife element drive system.

20. A folding apparatus according to claim 19, wherein each end of the knife element is attached to a substantially L-shaped knife element carrier.

21. A folding apparatus according to claim 20, wherein each substantially L-shaped knife element carrier includes first and second pins, wherein the first pin is located in a slide and is arranged for free sliding and pivoting movement within the slide and the second pin is pivotally attached to a drive arm of the knife element drive system.

22. A folding apparatus according to claim 21, wherein the first pin is located on the substantially L-shaped knife element carrier towards a rear edge of the knife element.

23. A folding apparatus according to claim 21, wherein the second pin is located on the substantially L-shaped knife element carrier ahead of the knife edge.

* * * * *